US006523682B1

(12) United States Patent
Focke et al.

(10) Patent No.: US 6,523,682 B1
(45) Date of Patent: Feb. 25, 2003

(54) CIGARETTE PACK AND PROCESS AND APPARATUS FOR PRODUCING THE SAME

(75) Inventors: Heinz Focke, Verden (DE); Hermann Blome, Blender-Einste (DE); Burkard Roesler, Blender (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/469,363

(22) Filed: Dec. 22, 1999

(30) Foreign Application Priority Data

Dec. 28, 1998 (DE) ..... 198 59 949

(51) Int. Cl.[7] ..... B65D 85/10
(52) U.S. Cl. ..... 206/273
(58) Field of Search ..... 53/444, 466; 206/256, 206/265, 268, 271, 273; 493/160

(56) References Cited

U.S. PATENT DOCUMENTS

| | | | | |
|---|---|---|---|---|
| 4,119,196 A | * | 10/1978 | Flaherty | 206/271 |
| 4,550,826 A | | 11/1985 | Asanuma | |
| 4,732,276 A | * | 3/1988 | Knecht | 206/268 |
| 5,193,328 A | * | 3/1993 | Boriani et al. | 53/466 |
| 5,251,748 A | * | 10/1993 | Adams et al. | 206/256 |

FOREIGN PATENT DOCUMENTS

| | | |
|---|---|---|
| DE | 1 757 190 | 5/1971 |
| DE | 2259193 | 6/1974 |
| DE | 1761160 | 1/1979 |
| DE | 33 40 408 | 5/1985 |
| DE | 35 15 655 | 11/1985 |
| DE | 35 29 119 | 2/1987 |
| EP | 1288970 | 2/1969 |
| EP | 443787 | 8/1991 |
| FR | 1443183 | 5/1966 |
| GB | 165891 | 7/1921 |
| GB | 200655 | 7/1923 |

* cited by examiner

*Primary Examiner*—Jim Foster
(74) *Attorney, Agent, or Firm*—Sughrue Mion, PLLC

(57) ABSTRACT

During the production of cigarette packs having an inner wrapper of thin packaging material, the blank (10) of the inner wrapper is provided with impressed lines, namely transverse impressed lines (19, 20) which delimit a base wall (11) which is first contacted by a cigarette group (23) when the latter is wrapped in a U-shaped manner. By virtue of the impressed lines (19, 20), the mechanical load forces exerted on the cigarette group during the U-shaped folding process is reduced. Furthermore, a cigarette conveyor (25) for transferring the cigarette groups (23) is driven in a non-uniform manner, i.e. at reduced speed, when receiving a blank (10), and at a correspondingly greater speed during other conveying operations.

1 Claim, 4 Drawing Sheets

10
12
20
11
19
13

10
18
14
Pull
16
17
12
45
44
20
42
44
45
19
11
II
II
13
16
17
21
15
45
44
43
45
44
22

CIGARETTE PACK AND PROCESS AND APPARATUS FOR PRODUCING THE SAME

BACKGROUND OF THE INVENTION

The invention relates to a cigarette pack having an elongate blank which is made of thin packaging material, such as paper, tin foil or the like, and is intended for wrapping a cigarette group such that the blank has a continuous, single-layer base wall which is adjoined by a front wall and a rear wall, the cigarette group, which butts against the base wall by way of end surfaces of the cigarettes, being wrapped in a U-shaped manner in the process, it being the case that the base wall is adjoined laterally by base folding tabs and the front wall and rear wall are adjoined laterally by side tabs for forming folded side walls of the wrapper. The invention also relates to a process and apparatus for producing cigarette packs of the abovementioned type.

The types of cigarette pack which are most commonly known throughout the world, namely hinge-lid packs and soft-carton packs, are constructed such that the cigarette group is enclosed by an inner wrapper made of thin packaging material, namely tin foil or paper in particular. The cigarette group is wrapped so as to form a continuous base wall against which the cigarettes butt by way of end surfaces. (Narrow) Side walls and an end wall, which is located opposite the base wall, are formed by overlapping folding tabs.

In a first folding step, the blank of the inner wrapper is folded around the cigarette group in a U-shaped manner, said cigarette group being transported by a cigarette conveyor and the blank being held on standby transverse to the conveying plane as a curtain for being carried along by the cigarette group.

As the operating speed of the packaging machines increases, the problem of mechanical loading of the cigarettes becomes greater. Pressure and impact loading during the packaging process may result in the quality being impaired.

SUMMARY OF THE INVENTION

The object of the invention is to propose measures which, despite a relatively high operating speed of the packing machine, avoid, or reduce the risk of, the cigarettes being impaired.

In order to achieve this object, the cigarette pack according to the invention is characterized by the following features:

a) the base wall is separated off from the front wall and rear wall by transverse impressed lines in the region of right-angled folding edges, b) the transverse impressed lines extend merely in the region of the base wall and front wall and rear wall, but not in the region of the side folding tabs and base folding tabs.

According to the invention, it is merely those regions of the blanks which are gripped directly by the cigarette group and/or by the cigarette ends located at the front, as seen in the conveying direction, namely the base wall, which are bounded by preformed and/or pre-impressed folding lines, with the result that, here, the mechanical loading which occurs is reduced on account of the folding of the blank. The transverse impressed lines do not extend into the lateral regions of the blank, especially since, there, another, complex folding formation is provided by base folding tabs and folding gussets.

Further pre-impressed folding lines, namely longitudinal impressed lines, are provided for separating off a central, continuous region of the blank from lateral folding tabs.

According to the invention, all the folding tabs are provided on a material web for producing the blanks, the longitudinal impressed lines being continuous impressed lines.

Further measures are provided according to the invention in the region of the packaging machine. Thus, an endless cigarette conveyor, which removes the cigarette groups from a cigarette magazine and also transports said groups when the latter receive the blank for the inner wrapper, is driven in a non-uniform manner according to the invention such that, when the cigarettes are removed from the magazine and/or when the transversely directed blank is received, the conveying speed is lower and elsewhere the conveying speed is correspondingly higher. Accordingly, the movement characteristics of the cigarette conveyor are non-uniform with acceleration characteristics running in waveform.

A further special feature of the apparatus is that assigned to the latter, preferably directly in the region where the blank is fed to the respective cigarette group, is an impressing subassembly which, before the blank has been severed from a material web, provides impressed lines in the formation according to the invention.

Further details relate to conveying elements which facilitate the transfer of the blanks to the cigarette group and the U-shaped folding.

BRIEF DESCRIPTION OF THE DRAWINGS

Details of the pack, of the process and apparatus are explained more specifically hereinbelow with reference to the drawings, in which:

The drawings of the patent concern the configuration and production of cigarette packs which have an inner wrapper made of tin foil, paper or film. Such inner wrappers are used, in particular, for hinge-lid packs and soft-carton packs. FIG. 1 shows a blank 10 for such an inner wrapper, which is designed in accordance with the folded-bottom principle. A continuous base wall 11 is adjoined by a front wall 12, on the one hand, and by a rear wall 13, on the other hand. A (top) end wall , which is located opposite the base wall 11, comprises folded, partially overlapping end folding tabs 14, 15. Upright, narrow side walls likewise comprise folding tabs, namely side folding tabs 16 and 17. In the region of the base wall 11, these merge into base folding tabs 42, 43, which adjoin the base wall 11, and folding gussets 44, which are arranged alongside the base folding tabs. The base folding tabs and folding gussets are separated from one another by folding lines 45.

Provided in the region of the front wall 12 is a transversely directed perforation 18 which bounds an end-side region of the blank. This end-side region serves as a so-called flap, which, when the pack is opened for the first time, is drawn off by virtue of the end wall tab 14 being gripped.

Figures 1, 2:
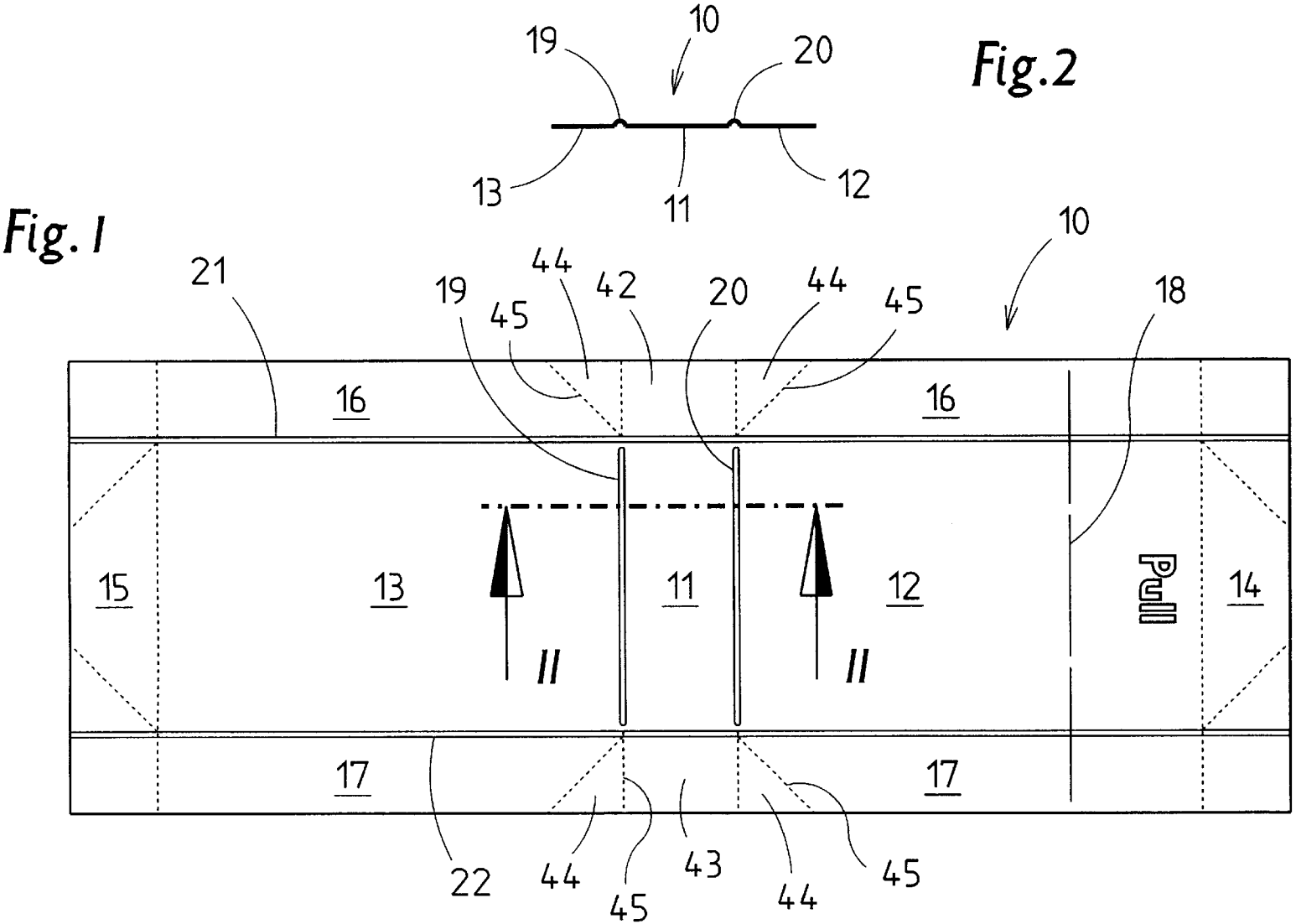
FIG. 1 shows a spread-out blank for an inner wrapper of a cigarette pack.
FIG. 2 shows a cross section of part of the blank along section plane II—II.
Figure 3:
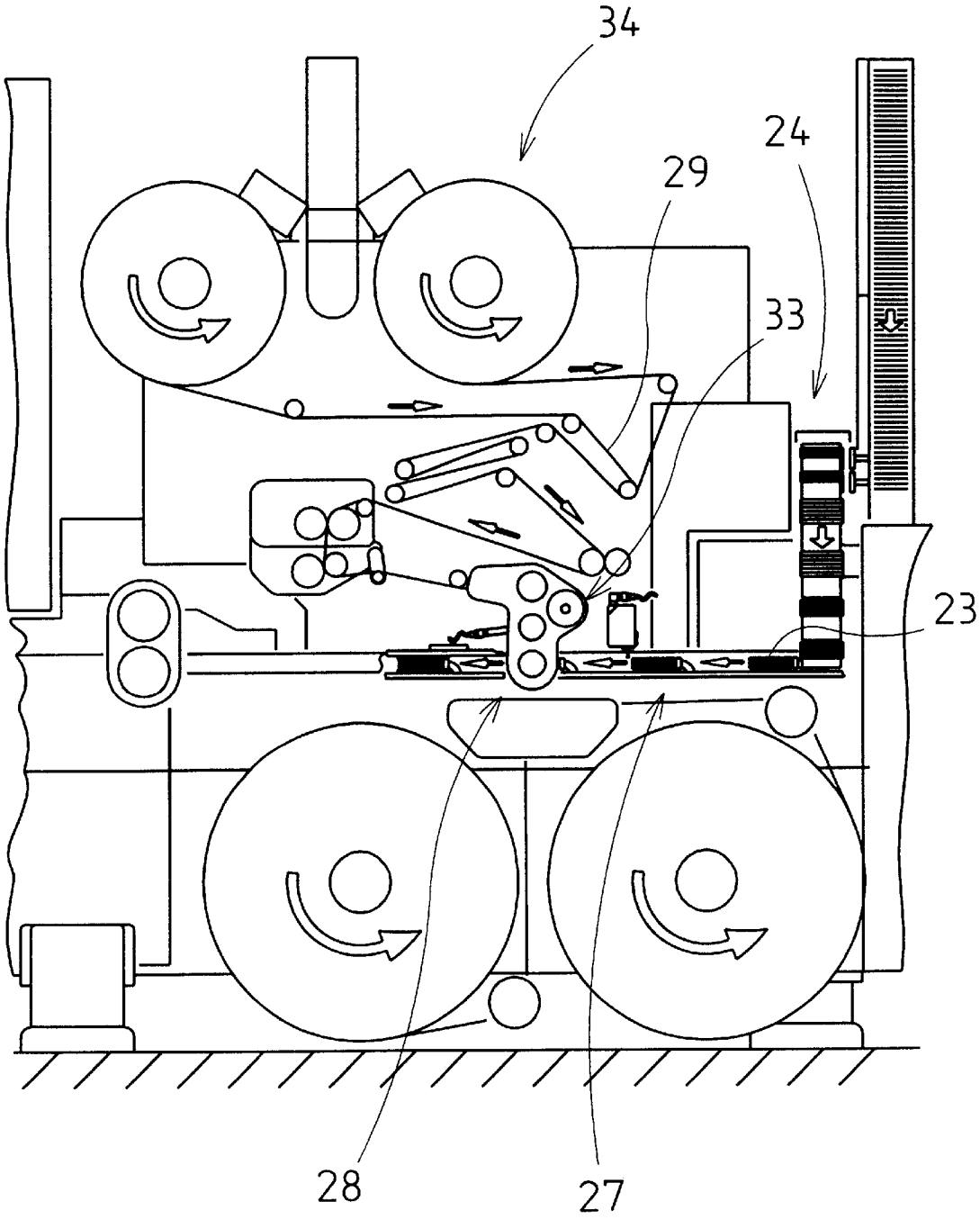
FIG. 3 shows a schematic side view of part of the packaging machine for cigarettes.
Figure 4:
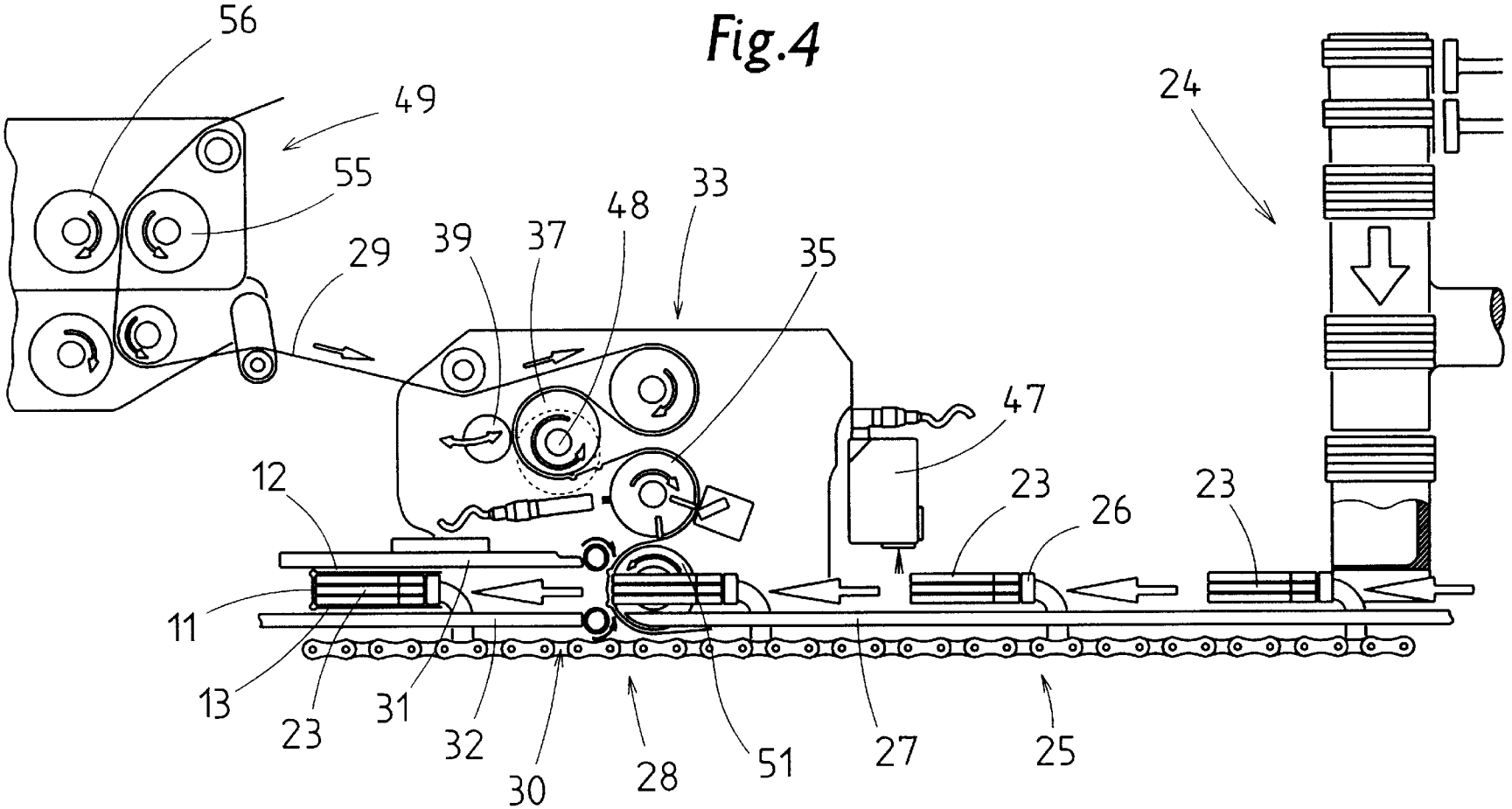
FIG. 4 shows, on an enlarged scale, a detail of the apparatus according to FIG. 3.
Figure 5:
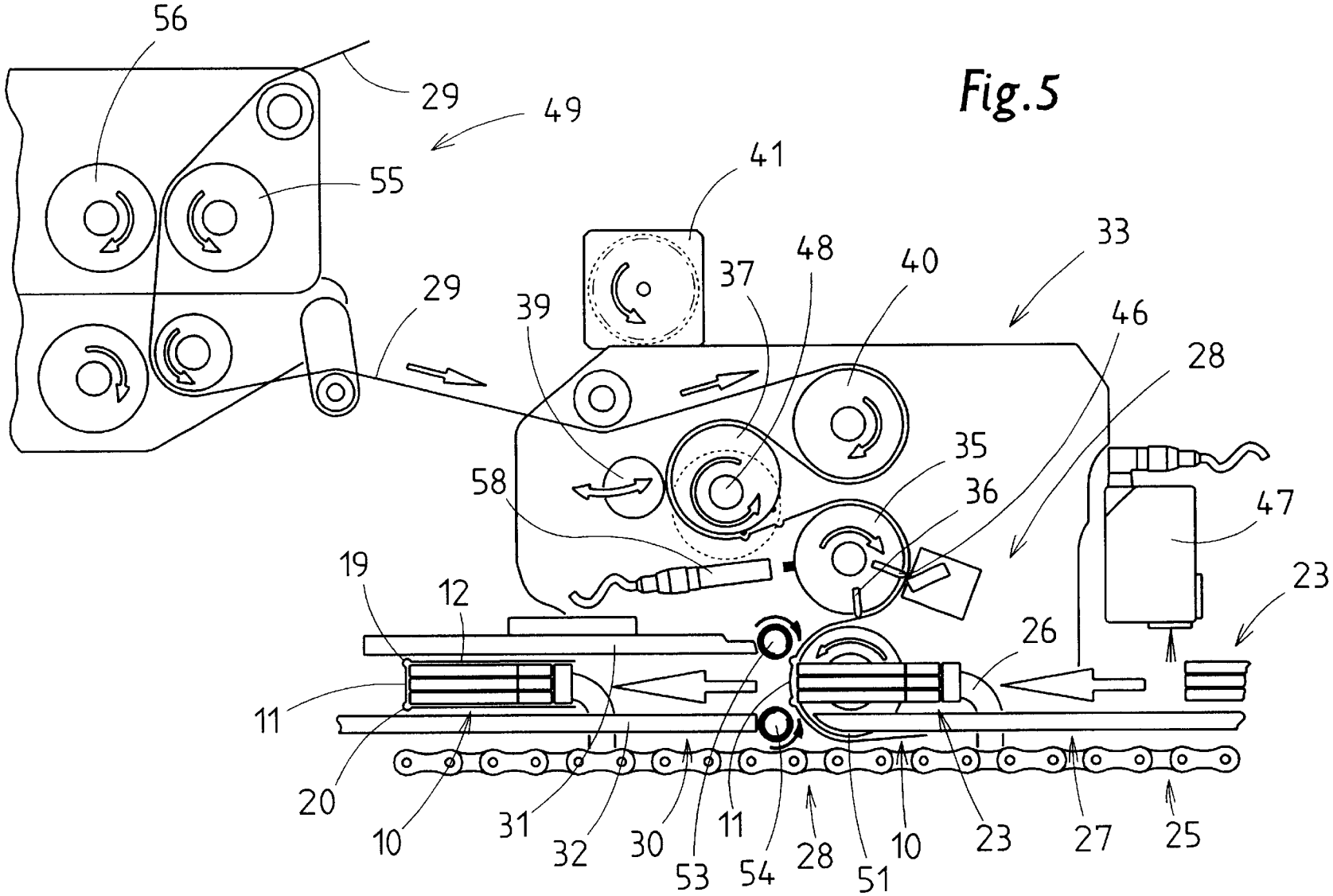
FIG. 5 shows, on a further-enlarged scale, a subassembly for feeding and transferring blanks to cigarette groups.

Although it consists of thin packaging material, the blank 10 is provided with impressed lines, namely scores, which constitute a groove-like deformation of the material (FIG. 2). The invention provides two parallel, transversely directed impressed lines, namely transverse impressed lines 19, 20. These bound the base wall 11 with respect to the front wall 12 and rear wall 13. The transverse impressed lines 19, 20 form base-side folding edges with a right-angled cross section.

Also provided are longitudinal impressed lines 21 and 22 of the same configuration, these running in the longitudinal direction of the blank 10. These separate off the strip-like side folding tabs 16, on the one hand, and 17, on the other hand, from the rest of the blank 10. In the case of this example, the transverse impressed lines 19, 20 extend between the longitudinal impressed lines 21, 22, but they may also, alternatively, extend over the entire width of the blank 10.

The cigarette groups 23 which are to be wrapped are removed from a cigarette turret 24, which is assigned to a cigarette magazine, and conveyed away. A cigarette conveyor 25 with carry-along elements 26 arranged at regular intervals grips the cigarette groups 23 on the rear side of the latter. The cigarette groups 23 are conveyed on the cigarette path 27.

DETAILED DESCRIPTION OF THE INVENTION

In the region of a blank station 28, blanks 10 are fed one after the other and are held on standby in order to be received by in each case one cigarette group 23. The blanks 10 are severed from a continuous material web 29 made of paper, tin foil or some other packaging material and are held on standby, as a curtain, in a position transverse to the movement direction of the cigarette groups 23.

In the region of the blank station 28, the blank 10 is positioned such that the cigarette group 23 grips the blank 10, by way of end surfaces which are located at the front, and seen in the conveying direction—filter-free cigarette ends—in the region of the base wall 11, namely precisely between the two transverse impressed lines 19, 20. As the conveying movement of the cigarette group 23 continues, the blank is folded in a U-shaped manner. Arranged in the region of the blank station 28, for this purpose, is a mouthpiece 30 with guides, namely mouthpiece plates 31, 32 above and beneath the movement path of the cigarette group 23.

The blank station 28 is assigned a blank subassembly 33. The latter is fed the material web 29—coming from a reel 34. The blank 10 is severed from the material web 29 by a severing subassembly, namely by a cutting roller 35 with severing cutter 46, and fed to the respective cigarette group 23. The cutting roller 35 is also equipped with a perforation cutter 36 for producing the perforation line 18.

The blank subassembly 33 has an impressing element for providing the transverse impressed line 19, 20. This element is an impressing roller 37. Provided on the circumference of the same are impressing tools, namely two transversely directed rib-like impressing protrusions 38. The impressing roller 37 is arranged upstream of the cutting roller 35, as seen in the conveying direction. The transverse impressed lines 19, 20 are accordingly provided on the material web 29. A mating pressure-exerting element, namely a (moveable) pressure-exerting roller 39, butts against the circumference of the impressing roller 37, or on the material web 29, at least during the impressing operation. The pressure-exerting roller 39 can be moved cyclically, e.g. via a crank, and at least partially consists of elastic material, e.g. Vulkolan. The impressing roller 37 has arranged upstream of it a deflecting roller 40, which produces a large wrap angle on the impressing roller 37.

The longitudinal impressed lines 21, 22 are produced in the material web 29 by an independent impressing subassembly which, in the case of the present exemplary embodiment, is arranged upstream of the blank subassembly 33, as seen in the transporting direction. A separately arranged impressing subassembly 49 has two impressing rollers 55, 56 which constantly butt against one another and of which one—e.g. the impressing roller 55—has two encircling, annular impressing ribs (not shown) corresponding to the position of the longitudinal impressed lines 21, 22. The other impressing roller 56 may serve as a pressure-exerting roller, preferably likewise with an elastic casing. The material web, which is impressed constantly by the impressing subassembly 49, is fed to the abovedescribed blank subassembly 33 over deflecting and guide rollers.

A special feature is that the blank subassembly 33, including impressing element, is driven independently, that is to say not by the central driving mechanism of the packaging machine, but in coordination therewith. The blank subassembly 33 is assigned a motor, namely a servomotor 41. The latter drives a central drive wheel.

The drive of the blank subassembly 33 is controlled in dependence on the position of the fed cigarette groups 23. This measure achieves the situation where the blank 10 is held on standby in a precise relative position—as far as the transverse impressed line 19, 20 is concerned—for being received by the cigarette group 23. Arranged above the conveying path for the cigarette group 23 is a sensing element, namely an optoelectronic sensor 47. The latter senses the front side of a cigarette group 23 by way of a light barrier and controls the servomotor 41 and thus the feeding of the blank 10 in precise coordination with the cigarette groups 23 which actually arrive. If it is thus the case that no cigarette groups are fed to the blank subassembly 33, or detected by the sensor 47, the feeding of the packaging material is also stopped.

However, the blank subassembly 33 is driven by the servomotor 41 in coordination or synchronously with the timing of the machine. For this purpose, a sensor, namely an initiator 58, is assigned to the blank subassembly 33. Said initiator interacts with a (metallic) marking 59 of the blank subassembly 33. The marking 59 is provided on the cutting roller 35 and controls the drive of the blank subassembly 33 in coordination with the timing of the machine.

A special feature of the apparatus is that the cigarette groups 23 are conveyed in a non-uniform manner, namely at an increasing and correspondingly decreasing conveying speed. The drive is selected such that, as a cigarette group 23 is received in the region of the cigarette turret 24, the cigarette conveyor 25 has a reduced speed. Equally, a reduced speed of the cigarette conveyor 25 is provided as a blank 10 is received by a cigarette group 23. During the rest of the conveying phase, the cigarette conveyor 25 is driven at a correspondingly higher speed. The procedure is preferably such that one cigarette group 23 is gripped in the region of the cigarette magazine 24 at the same time as a blank 10 is gripped by another cigarette group 23. In this case, the cigarette conveyor may be driven, for example, in accordance with DE 1 288 970, that is to say at a speed which alternates cyclically.

The movement characteristics of the blank subassembly 33 are adapted to the movement characteristics of the cigarette conveyor 25, that is to say they are non-uniform and surge and subside. The characteristics of the conveying movement are selected such that, as a blank 10 is received by a cigarette group 23, the conveying speed of the blank 10 is reduced, but is otherwise correspondingly increased. This conveying movement of the material web 29 and/or the blank 10 is brought about by the impressing roller 37, which is designed and mounted as an eccentric roller, that is to say with an eccentric axis of rotation 48. The arrangement is such that the impressing roller 37 is conveyed at reduced speed during the impressing operation, that is to say during the time over which the transverse impressed line 19, 20 is being provided, and at a correspondingly higher speed thereafter.

The blank 10, which is severed from the material web 29, is transferred from the cutting roller 35 to rotating suction discs 51. The suction discs 51 are provided along the circumference with suction bores and grip the blank at lateral borders. The cigarette groups 23 can be conveyed through between the suction discs 51, the blank being gripped by the cigarette group 23, and drawn off from the suction discs 51, in the region of the base wall 11.

Arranged in the region of the mouthpiece 30 are further auxiliary elements which help the blank 10 to be carried along by the cigarette group 23 in a manner which is free of loading. These elements are suction rollers 53, 54 which have their axes positioned transversely to the conveying direction of the cigarette groups 23, above and beneath the movement path of the same, said suction rollers specifically being in the form of inlet elements of the mouthpiece 30. The cigarette group 23 is conveyed, with the blank 10, between the top and bottom suction rollers 53, 54.

The specific method of driving the cigarette conveyor 25 may also be used in some other context, that is to say independently of the operation for impressing the inner wrapper.

What is claimed is:

1. A cigarette pack having an elongated blank (10), which is made of thin packaging material of paper or tin foil, forming an inner liner for direct wrapping of a cigarette group (23), characterized in that:

a) the blank (10) forms a continuous, single-layer base wall (11) which is adjoined by a front wall (12) and by a rear wall (13), with the cigarette group (23) abutting the base wall (11) with end surfaces of cigarettes in the cigarette group, b) laterally adjoined to, and on opposite sides of, the base wall (11), the front wall (12) and the rear wall (13) are respective continuous blank strips comprising side folding tabs (16, 17), in a region of the front wall (12) and the rear wall (13), and base folding tabs (42, 43) in a region of the base wall (11), c) the blank (10) has two continuous longitudinal impressed lines (21, 22), running in the longitudinal direction of the elongated blank, which delimit a middle region of the blank from the continuous blank strips which are formed on said opposite sides and which contain the side folding tabs (16, 17) and the base folding tabs (42, 43), said middle region comprising the base wall (11), the front wall (12), the rear wall (13) and end folding tabs (14, 15), d) two transverse impressed lines (19, 20), which delimit the base wall (11) from the front wall (12) and from the rear wall (13), respectively, extend only between the longitudinal impressed lines (21, 22), and e) the respective continuous blank strips, formed from the side folding tabs (16, 17) and the base folding tabs (42, 43), are free of impressed lines.

* * * * *